United States Patent [19]

Stevenson

[11] 4,450,776

[45] May 29, 1984

[54] INDUSTRIAL FURNACE

[76] Inventor: Robert L. Stevenson, 9003 West Evans, Rogue River, Oreg. 97537

[21] Appl. No.: 503,342

[22] Filed: Jun. 10, 1983

[51] Int. Cl.[3] ..... F23B 7/00

[52] U.S. Cl. ..... 110/233; 110/110; 110/162; 110/165 R; 110/260

[58] Field of Search ..... 110/233, 234, 110, 162, 110/260, 261, 262, 165 R

[56] References Cited

U.S. PATENT DOCUMENTS

| | | | |
|---|---|---|---|
| 974,322 | 11/1910 | Wells . | |
| 1,929,424 | 10/1933 | Heaton . | |
| 2,286,519 | 6/1942 | Torr . | |
| 3,756,201 | 9/1973 | Williams . | |
| 3,926,173 | 12/1975 | Jury . | |
| 4,017,254 | 4/1977 | Jones | 110/233 X |
| 4,078,541 | 3/1978 | Roycraft . | |
| 4,080,932 | 3/1978 | Northcote . | |
| 4,201,187 | 5/1980 | Skow . | |
| 4,253,407 | 3/1981 | Larson . | |

*Primary Examiner*—Edward G. Favors

*Attorney, Agent, or Firm*—Eugene M. Eckelman

[57] ABSTRACT

A firebox has a liquid or gaseous burner and also a solid fuel grate assembly associated with a solid fuel inlet above the grate assembly for dropping solid fuel particles thereon. The grate assembly includes upper and lower bar type members and an intermediate member of expanded metal. A blower is mounted under the grate assembly and in combination with the latter provides an even pressurized draft for burning solid fuel particles. A sweeping bar on side runs is capable of sweeping clinkers and ashes from the grate assembly. A bottom auger receives the clinkers and ashes and carries them out of the firebox. A forced air inlet directs a flow of air down on the solid fuel inlet to prevent combustion gases from traveling reversely through the solid fuel inlet. A heat exchange chamber includes a plurality of reversely turned tubes arranged in a plurality of paths and connected by end housings capable of removal for inspection and cleaning. The solid fuel is fed to the furnace by a metering unit for use in combination with blowers to achieve maximum efficiency of the furnace.

10 Claims, 7 Drawing Figures

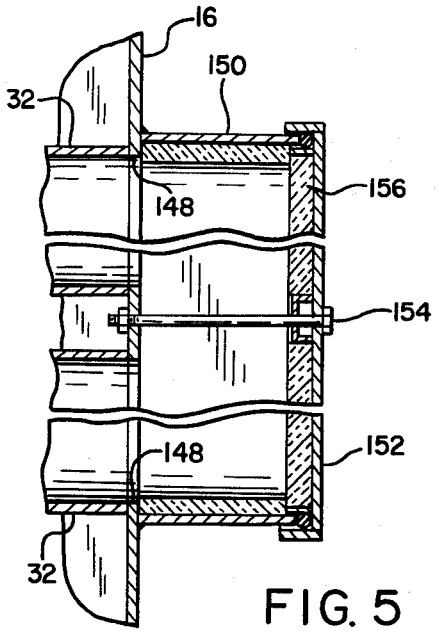
FIG. 5
FIG. 6
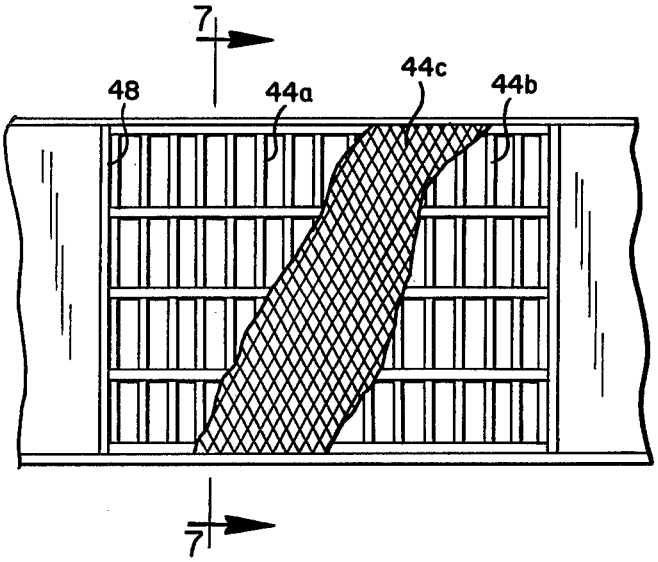
FIG. 7
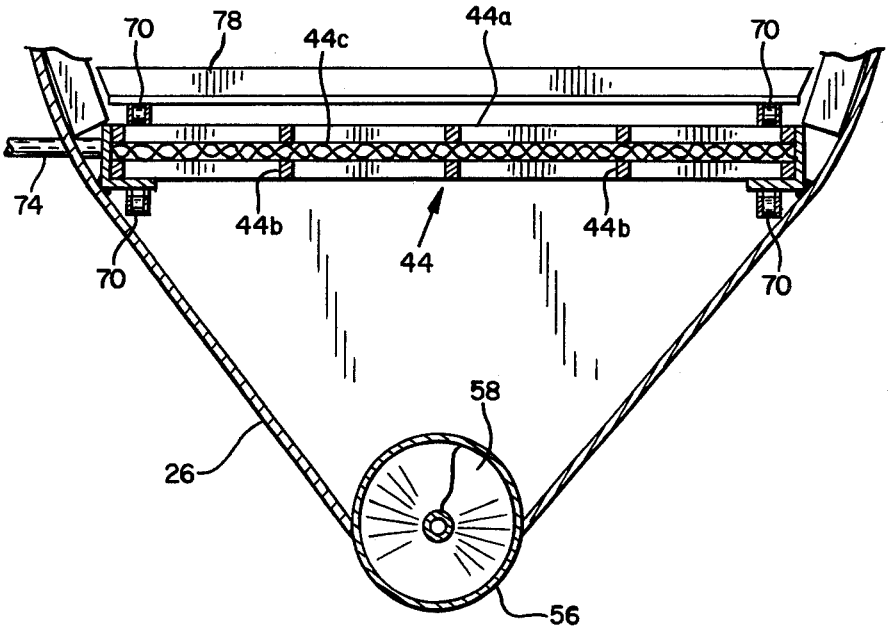

INDUSTRIAL FURNACE

FIELD OF THE INVENTION

This invention relates to new and useful improvements in industrial furnaces.

SUMMARY OF THE INVENTION

An object of the invention is to provide an industrial furnace employing a combination of features that provide a highly efficient output with low fuel cost, low construction cost, and minimum and ease of maintenance.

A more particular object is to provide an industrial furnace having a solid fuel feed as well as a gaseous or liquid fuel feed, these fuel feeds being controllable whereby to provide ignition and buildup to a maximum and efficient heat output as well as to maintain said output. It is a further object to provide in said furnace a controllable volume primary draft means from under the grate as well as a controllable volume secondary or induced draft at the outlet stack, thus providing a novel combination of controllable solid and gaseous or liquid fuel feed and controllable primary and induced drafts to accomplish maximum as well as constant output. Such controllable features also contribute to a furnace which emits minimum products of combustion, such emissions being within the requirements of the Department of Environmental Quality.

Another object is to provide a novel heating chamber and heat tube arrangement therein facilitating efficient heat pickup, low emission at the stack, and easy clean-out of the tubes.

Another object is to provide means to prevent reverse flow of combustion gases or reverse burn through the solid fuel feeder.

Still another object is to provide a novel grate system in said furnace for effecting efficient combustion and easy removal of ashes and clinkers.

The invention will be better understood and additional objects and advantages will become apparent from the following description and as shown in the drawings.

BRIEF DESCRIPTION OF THE DRAWINGS

FIG. 5 is an enlarged fragmentary sectional view taken on the line 5—5 of FIG. 2, FIG. 6 is a top plan view of the grate assembly of the furnace, this view being taken on the line 6—6 of FIG. 3 and being partly broken away; and FIG. 7 is a sectional view taken on the line 7—7 of FIG. 6.

DETAILED DESCRIPTION OF A PREFERRED EMBODIMENT

Figure 1:
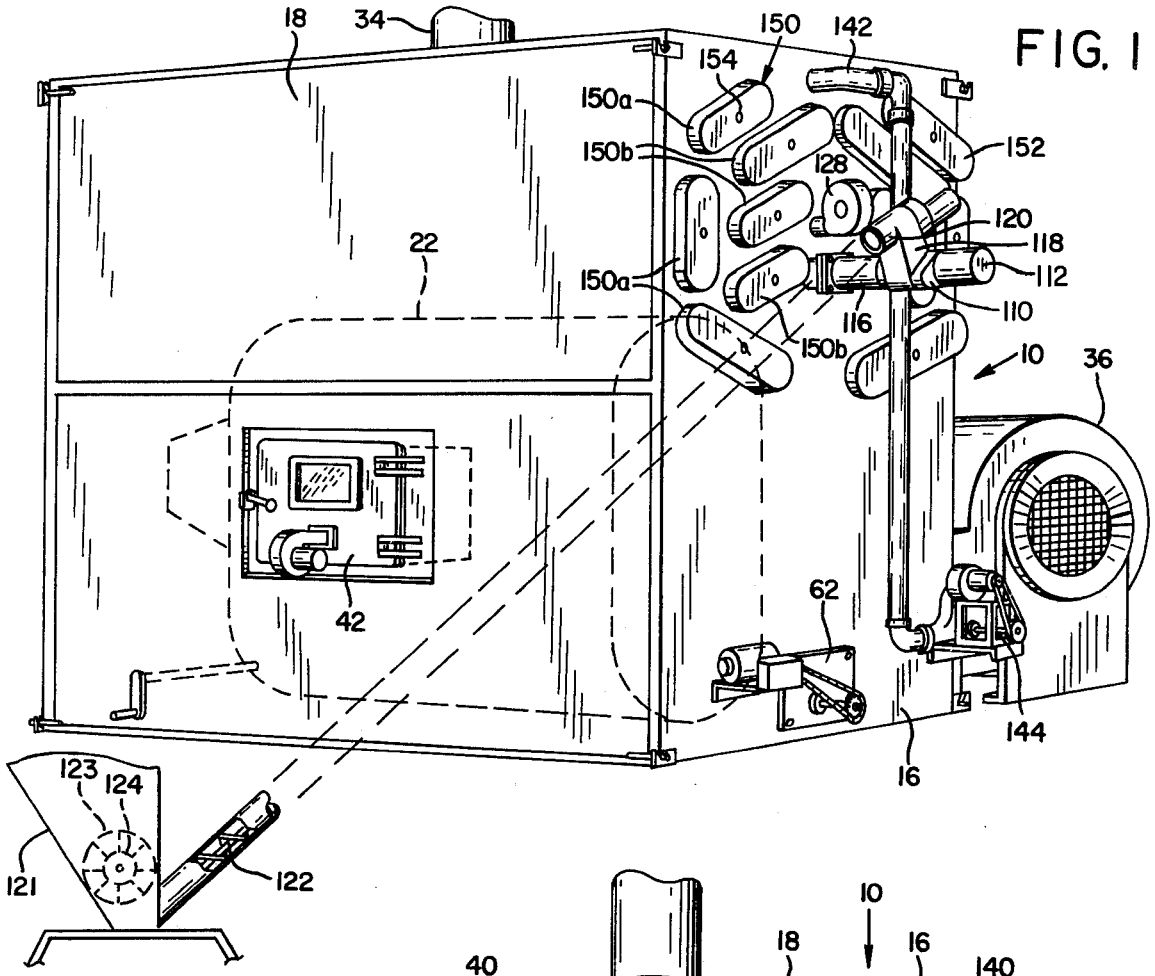
FIG. 1 is a perspective view of the industrial furnace embodying the instant invention, this view being taken from the front of the furnace.

With particular reference to the drawings, the furnace of the invention includes a housing 10 having a bottom support wall 12, a top wall 14, end walls 16, and front and rear walls 18. The lower portion of the housing 10 encloses a firebox 22 having a rounded upper end 24, best seen in FIG. 4, and a narrowing or tapered bottom portion 26. The firebox is smaller than the overall dimension of the housing to allow for circulation of air around it, and is supported above the bottom 12 by frame members 28 to accomplish complete circulation. The upper end of the housing 10 comprises a heating chamber 30 employing a plurality of heat exchange tubes 32 for carrying away flue gases from firebox 22 to an outlet stack 34 in an arrangement to be detailed hereinafter. One or more large blowers 36 are disposed at the rear of the housing 10 and force outside air through openings 38 at a lower portion of the housing up around the firebox, through the heating chamber 30, and out an opening 40 in the rear wall of the furnace for supply to suitable heating ducts. The front wall of the furnace has an inspection door 42.

A grate assembly, FIGS. 3, 6 and 7, 44 is mounted in the lower portion of the firebox for supporting solid fuel. This assembly is supported on longitudinal rails 46. End walls 48 are associated with the grate assembly and, together with the tapered sides 26 of the firebox, form a central well 50 under the grate. An auxiliary well 54 is provided at each of the far ends of the grate assembly, and these wells open through their bottom ends into a longitudinal tube 56 extending from end to end of the housing 10 and having an auger 58 therein. Tube 56 has opposite end caps 60, and the shaft of the auger 58 extends through one of these caps and is driven by a motor assembly 62 mounted exteriorly of the housing 10. Tube 56 has a bottom opening 64 at the motor end for discharging ashes conveyed by the auger. Grate assembly 44 is made up of three elements comprising upper and lower bar type grates **44*a* and 44*b*, respectively, best seen in FIGS. 6 and 7, and an expanded metal grate 44*c* therebetween. The size of the openings in the element 44*c*** is preselected such that a forced draft can move therethrough in an even distribution but at the same time ashes cannot fall through the grate assembly.

Figure 3:
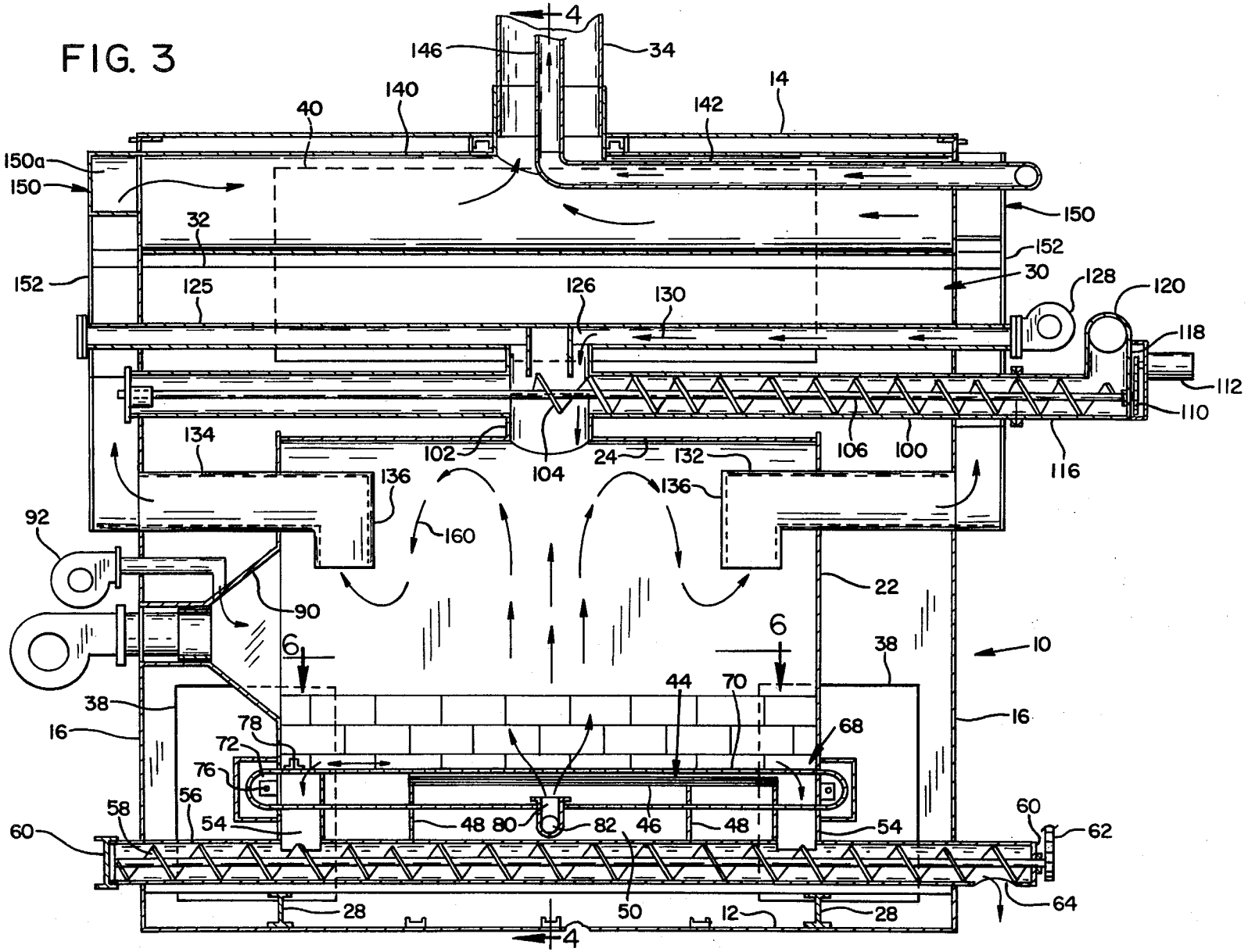
FIG. 3 is a longitudinal sectional view taken on the line 3—3 of FIG. 4.

Also associated with the grate assembly 44 is an endless drive member comprising a pair of chains 70 located in spaced relation at the front and rear of the grate and operating over end sprockets 72. The shaft 74 of one of the sprockets extends to the exterior of furnace and has a projecting end to which a hand crank 76 can be attached, FIG. 4, for manually operating the drive members 70. The two chains 70 carry a cross bar 78, which upon manual operation of the drive member 68 in a reciprocating movement can be caused to sweep off clinkers and ashes from the grate. FIGS. 3 and 7 show opposite end positions of the bar 78.

An air outlet nozzle 80 is mounted under the grate which communicates with a conduit 82 leading to a blower 84.

A liquid or gaseous fuel burner 90, such as a Diesel burner, is mounted at one end of the housing 10 and communicates with one end of the firebox 22. This burner is of conventional construction and its output is controllable according to the demands of a thermostat. An auxiliary electric blower 92 is associated with the burner 90 and is used to protect this burner from excessive heat when it is shut off and solid fuel is being burned in the furnace.

A solid fuel inlet tube 100 is supported between the ends of the housing 10 and has a central depending spout 102 projecting in depending relation through the top wall of the firebox 22. Tube 100 contains an auger 104 therein with a shaft 106 having a drive connection 110 exteriorly of the housing 10 with an electric gear motor 112 suitably supported on the housing. The projecting end of tube 100, designated by the reference numeral 116, communicates with a vertical tubular portion 118 connected to the upper end of an inlet conduit 120 leading up from the bottom of a solid fuel feed hopper 121 offset from the furnace. Solid fuel particles from the hopper 121 are carried up the conduit 120 by a motor driven auger 122 or other feed mechanism in the conduit 120, and such particles upon being introduced to the vertical tubular portion 118 fall on the auger 104 and are carried to the outlet 102 over the grate assembly 44. Hopper 121 has a metering member 123 therein which is power driven by a motor unit 124 secured exteriorly of the hopper and having shaft connection with the metering member.

Associated with the solid fuel feed mechanism is an air inlet conduit 125 having an outlet 126 directed downwardly through the tube 100 and through the solid fuel outlet spout 102. The outer end of the air inlet conduit 125 has a blower 128 associated therewith for supplying air down across the spout 102, as designated by arrows 130 in FIG. 3. Such forced air prevents reverse flow of flue gases through the solid fuel feed. Such air flow is not intended to contribute to the combustion of the fuel. Conduit 125 extends the fuel width of the housing 10 so that the blower 128 can be mounted on either end, a suitable symmetrical outlet 126 above the spout 102 also being provided for this purpose. Likewise, the solid fuel inlet tube extends the full width of the housing 10 and with slight mechanical alteration can feed fuel from either end by appropriate mounting of the inlet portions 118 and 120 and the drive assembly 110, 112. It is desired for most efficient prevention of reverse flow of flue gases through the solid fuel feed tube that the blower 128 be disposed at the same end as the infeed of the solid fuel so that the air flow from the blower 128 is directly down on the chips as they fall from the auger.

Heat exchange tubes 32 are arranged in a particular manner for a most efficient manner of heating the chamber 30, of reducing products of combustion that are discharged through the stack 34, and for easy cleanout. For this purpose, the firebox is provided with a pair of heat exchange inlets 132, or firebox outlets, at one end and similar inlets 134 at the other end. Each of these inlets has downturned elbows 136 which pick up the products of combustion. These inlets communicate with a top enlarged tubular passageway 140 extending longitudinally of the housing 10 and communicating with the stack 34. Such communication is through the elongated path of the heat exchange tubes 32, to be described, and such movement is induced by air admitted through a conduit 142 associated with a blower 144. The outlet 146 extends a short distance up the stack 34. Blower 144 is controllable in volume to accomplish maximum efficiency in combination with other features of the furnace, as will be more apparent hereinafter.

The pair of inlet tubes 132 and 134 at the ends of the firebox are symmetrical in their association with a series of the heat exchange tubes 32 and only one side of the firebox will thus be described.

Figure 4:
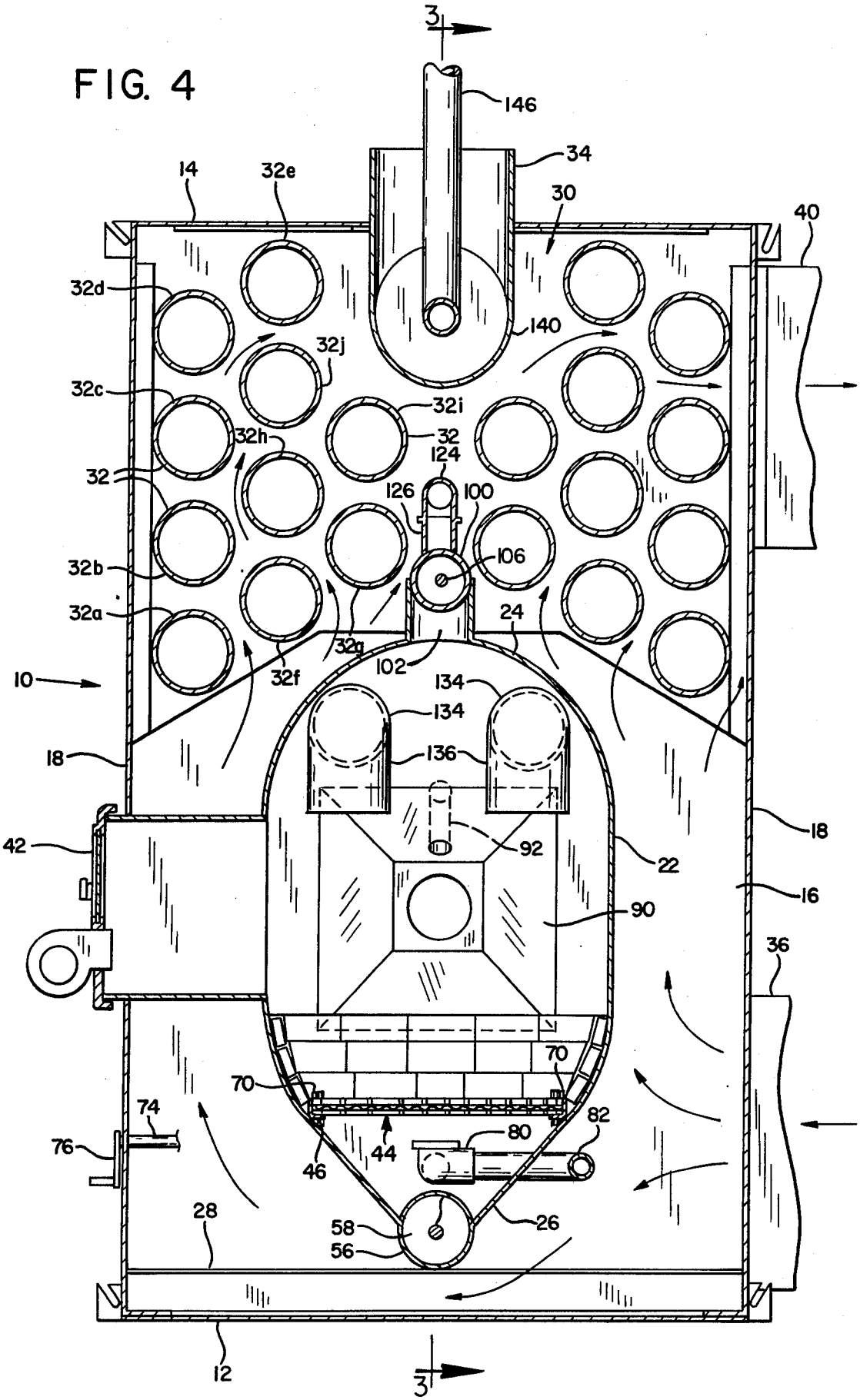
FIG. 4 is a cross sectional view taken on the line 4—4 of FIG. 3.

With reference first to FIG. 4, two sets of the heat exchange tubes extend the full width of the housing 12. One set of the tubes is identified by reference numerals 32*a*, 32*b*, 32*c*, 32*d*, and 32*e*. The other set of heat exchange tubes is designated by the numerals 32*f*, 32*g*, 32*h*, 32*i*, and 32*j*. With reference to FIG. 5, all of the tubes 32 have end openings 148 through the end walls of the housing 10 and are associated with reversing housings 150 secured, as by welding, to the end walls 16 of the housing 10 and associated with cover plates 152 removably mounted on the housings 150 by attaching screws 154. Housings 150 and cover plates 152 have interior insulation 156. These housings cover the openings of a pair of the outlet tubes 32 and reverse the direction of flow from one tube to the other.

Figure 2:
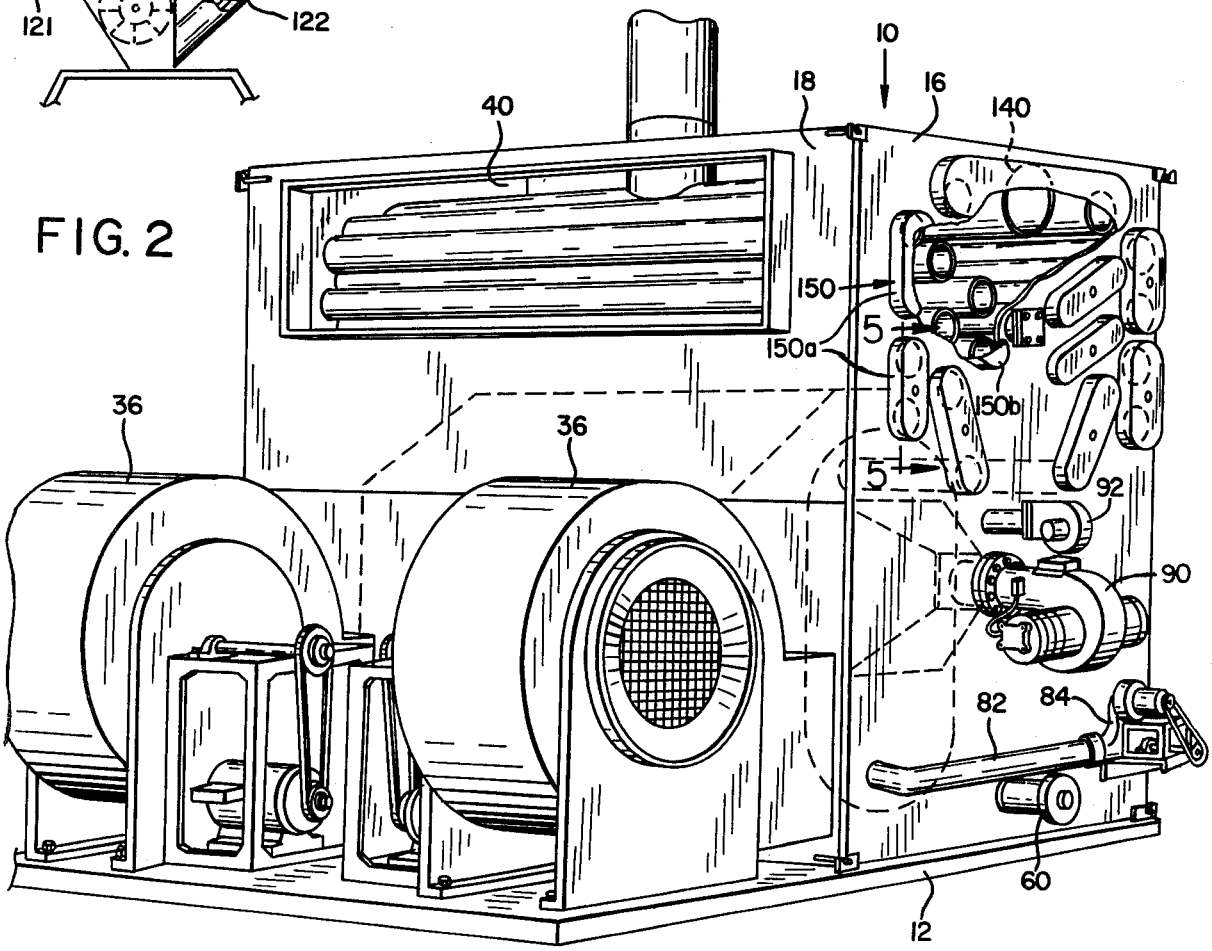
FIG. 2 is a perspective view as taken from the rear of the furnace.

The arrangement of tube connections is apparent in FIGS. 1, 2 and 4. The reference numerals 150*a* in FIGS. 1 and 2 represent opposite end housings that provide communication between a flue inlet 132 at one side of the firebox with a first or lowermost heat exchange tube 32*a* and then back and forth circulation in tubes 32*b*, 32*c*, 32*d*, 32*e* and then to the enlarged tubular passageway 140. The reference numerals 150*b* represent end housings that provide communication between a flue inlet 134 at the opposite end and on the same side of the firebox with the lowermost heat exchange tube 32*f* and then back and forth circulation in tubes 32*g*, 32*h*, 32*i*, and 32*j* and then to enlarged passageway 140. The other two flue inlets 132 and 134 on the other side of the firebox have an identical association with heat tubes, thus in all totaling four elongated series of tubes which in a normal size furnace total at least 250 feet of heat exchange tubes.

The structure of the furnace as above described accomplishes a most efficient consumption of fuel and at the same time provides maximum heat output and minimum emissions from the stack, as well as minimum maintenance and repair. Suitable controls are provided for controlled operation of the liquid fuel burner 90 for ignition of the solid fuel, and controlled operation of the solid fuel drive means 112 in combination with the output of the liquid fuel burner can provide maximum efficiency. In a preferred arrangement, the liquid fuel burner 90 is operated as stated to ignite the solid fuel and also by suitable control of sensing means from the heat output or the stack, such liquid fuel burner serves as a standby to assist the solid fuel heat output if needed. Otherwise, the liquid fuel burner 90 is shut off and the furnace operated with the more economical solid fuel. The solid fuel in particle form falls evenly on the grate without obstruction, and such even distribution and underneath forced draft provide maximum efficiency of combustion.

Such even input of the solid fuel is accomplished by the fuel metering unit 123, the metering unit being controllable in is feeding speed or output such that said feed can be precisely set according to the type or condition of the solid fuel. This infeed is used in combination with the draft through the outlet nozzle 80 under the grate and the controlled induced draft through the tube 142 at the stack for maximum output efficiency and constant heat output. The draft from nozzle 80, due to the expanded metal grate element 46*c* becomes somewhat pressurized and it thus distributes evenly in the area 50 and up through the solid fuel deposited on the grates. Since the area 50 is closed except at the top, this pressure is confined and can only escape through the grates.

The four elongated paths of heat exchange tubes 32 provide even temperature distribution through the heating chamber and maximum transfer of heat to such chamber. As noted in FIGS. 3 and 4, circulation from blowers 36 extends fully around the firebox.

As stated hereinbefore, the force air from conduit 124 is intended to prevent reverse flow of flue gases and not to assist in combustion. As an example, it is found that with the outlet 80 discharging 2000 CFM, an output of 200 CFM in outlet 126 accomplishes the intended purpose.

The controlled combustion of the solid fuel and preferably a maximum output of the furnace at all times, results in minimum soot and ash. Much of the heavier products of combustion fall to the furnace floor in that with the flue outlets 132 and 134 having a downturned end and being disposed adjacent the ends of the firebox, the flames and smoke cannot travel directly into them. Instead the flames and smoke travel up to the top of the firebox and then split and travel horizontally across the top of the firebox. The flames and smoke then turn downward to find their way into the four firebox outlets. The path of the flames and smoke is shown by arrows 160. The elbows 136 may be longer if desired. Most soot and ash that leave the firebox will collect in the heat exchange tubes 32 and can be readily cleaned by removal of the cover plates 152.

The grate element 46*a* prevents ashes from falling through the grate assembly. If ashes or clinkers develop on the grates 44, they can be removed by operation of the grate sweeping unit 68 in one direction or the other. This cleaning operation can be accomplished without shutting down the furnace.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. An industrial furnace comprising a firebox defined by side and end walls, a top wall, and a floor having a solid fuel supporting grate assembly, an opening in said top wall vertically aligned over said grate, a tubular member having an inlet disposed exteriorly of said furnace and an outlet in communication with said top wall opening, means at the inlet of said tubular member for admitting a solid fuel in particle form, a power driven auger in said tubular member arranged to move solid fuel particles from said inlet to said outlet for deposit by gravity on said grate, a heating chamber above said firebox having a top wall and end and side walls, forced air means forcing air from an exterior inlet through said heating chamber to an outlet for heating use, an outlet stack supported on said heating chamber, heat exchange means communicating with said firebox and circulating through said heating chamber to said stack for discharging heat exchanged exhaust gases for heating the moving air in said heating chamber, controllable volume forced air draft means leading inwardly from the exterior of said furnace and directed upwardly through said grate for forcing combustion, and controllable volume forced air inlet means leading from the exterior of said furnace to said stack to provide an induced draft up said stack to aid combustion and circulation of products of combustion through said heat exchange means.

2. The industrial furnace of claim 1 including controllable liquid or gaseous burner means in said furnace at said firebox for providing controlled combustion alone or in combination with combustion from solid fuel admitted through said tubular member.

3. The industrial furnace of claim 2 including forced air inlet means leading inwardly from the exterior of said furnace and directed downwardly across said outlet of the tubular member to prevent combustion gases from traveling reversely through said tubular member.

4. The industrial furnace of claim 2 including forced air inlet means leading inwardly from the exterior of said furnace and having an outlet above said outlet of said tubular member and directed downwardly across said outlet to prevent combustion gases from traveling reversely through said tubular member, said forced air inlet means having reduced volume flow relative to said forced air draft means.

5. The industrial furnace of claim 1 wherein said heat exchange means comprises at least one horizontal tube at each end of said firebox having a downturned end facing said firebox, each of said horizontal tubes communicating with a heat exchange tube extending back and forth through said heating chamber in a plurality of runs terminating at the ends walls of said heating chamber and opening therethrough, and end caps removably mounted on the end walls of said heating chamber establishing communication between runs of said tubes.

6. The industrial furnace of claim 5 including at least two of said horizontal tubes at each end and communicating heat exchange tubes, thus providing at least four separate paths for products of combustion to said stack through said heating chamber.

7. The industrial furnace of claim 1 including endless drive means operating over said grate in end to end relation in close association with the upper surface thereof for scraping clinkers and ashes to one end, and receiving means at said one end to receive the clinkers and ashes and carry them away from the firebox.

8. The industrial furnace of claim 7 wherein said receiving means comprises a pit, and an auger operating horizontally through said pit for breaking and carrying away clinkers from said pit.

9. The industrial furnace of claim 1 wherein said grate assembly comprises upper and lower grate members having enlarged openings and also an intermediate member with openings of a reduced size capable of causing said forced air draft means to be pressurized under said grate assembly and evenly distributed through the latter.

10. The industrial furnace of claim 1 wherein said grate assembly is disposed inwardly of the ends of said furnace, said heat exchange means comprising inlets adjacent the ends of said firebox, said inlets having a horizontal portion and a right angle downwardly directed extension with a bottom open end, whereby in blowing into said inlets, combustion products first rise up against the said top wall of the firebox and then circulate down underneath the bottom opening of said extensions and out said inlets.

* * * * *